US007160165B2

(12) United States Patent
Jung

(10) Patent No.: US 7,160,165 B2
(45) Date of Patent: Jan. 9, 2007

(54) DEVICE FOR RIPPLING OF WATER

(76) Inventor: Hyung Kyu Jung, 446-2, Yusan-Ri, Gusan-Myeon, Habpo-Gu, Masan-City, Gyeongsangnam-Do, 631-843 (KR)

( * ) Notice: Subject to any disclaimer, the term of this patent is extended or adjusted under 35 U.S.C. 154(b) by 0 days.

(21) Appl. No.: 10/518,719

(22) PCT Filed: Jun. 16, 2003

(86) PCT No.: PCT/KR03/01173

§ 371 (c)(1),
(2), (4) Date: Sep. 19, 2005

(87) PCT Pub. No.: WO04/000639

PCT Pub. Date: Dec. 31, 2003

(65) Prior Publication Data

US 2006/0094317 A1 May 4, 2006

(30) Foreign Application Priority Data

Jun. 21, 2002 (KR) ..... 10-2002-0034899

(51) Int. Cl.
*B63B 35/83* (2006.01)
*B63B 35/74* (2006.01)

(52) U.S. Cl. ..... 441/76; 441/130; 472/129

(58) Field of Classification Search ..... 441/76, 441/77, 78, 109, 110, 129, 130, 131, 132; 434/254; 472/128, 129; 135/66, 67
See application file for complete search history.

(56) References Cited

U.S. PATENT DOCUMENTS 504,326 A * 9/1893 Chapman ..... 248/155.1
3,778,052 A * 12/1973 Andow et al. ..... 280/87.041
4,798,550 A * 1/1989 Biancucci ..... 441/129
5,092,589 A 3/1992 Packer
5,385,497 A * 1/1995 Chu ..... 441/129

FOREIGN PATENT DOCUMENTS

DE 4 402 607 A 7/1995
JP 09-39884 A 2/1997

* cited by examiner

*Primary Examiner*—Sherman Basinger
(74) *Attorney, Agent, or Firm*—Birch, Stewart, Kolasch & Birch, LLP

(57) ABSTRACT

A device for dabbling in water. A body section has a support frame which possesses a configuration of a ring so that a user can freely pass through the ring. A first floating section has first rods which are secured to the support frame to be spaced apart one from another by a predetermined angle in a circumferential direction and extend downward from the support frame, second rods which are respectively coupled to the first rods, and first floating parts which are respectively provided to lower ends of the second rods to float the supporting frame and a user. A second floating section has wires which are connected at one ends thereof to the support frame, and a pair of second floating parts which are connected to the other ends of the wires to be worn on the feet of the user.

5 Claims, 4 Drawing Sheets

DEVICE FOR RIPPLING OF WATER

TECHNICAL FIELD

The present invention relates, in general, to a device for dabbling in water, which is capable of facilitating the floating of a user on the surface of a river or the sea and, more particularly, to a device for dabbling in water, which is constructed to allow a user to float on the surface of water in a sitting posture so that the user can walk or enjoy dabbling on the surface of the water, thereby providing a degree of recreation.

BACKGROUND ART

Generally, dabbling implements are used to allow those incapable of swimming to float on water and enjoy dabbling in the water. The dabbling implements are divided into a first type employed in shallow water and a second type employed in deep water. The first type implements include various tubes to be filled with air, and life jackets to be put ion the upper part of the human body. The second type implements include a rubber boat on which a user can board to paddle, a motorboat which is moved by power generated by a motor, etc. Also, there are disclosed a diversity of diving apparatus for allowing a user to swim under water.

However, in the case of the tubes and life jackets, since the human body is partially submerged under water, motions of the user cannot be freely made, whereby it is impossible to enjoy dabbling in water. Also, in the case of a rubber boat and a motorboat, while it is possible to move on the surface of the water at a high speed and stop at a desired place on the surface of the water to enjoy paddling, they suffer from defects in that they are expensive.

DISCLOSURE OF THE INVENTION

Accordingly, the present invention has been made keeping in mind the above problems occurring in the prior art, and on object of the present invention is to provide a device for dabbling in water, which is constructed to allow a user to float on the surface of the water in a sitting posture so that the user can walk or enjoy dabbling on the surface of the water, thereby providing an increase in the degree of recreation.

In order to achieve the above object, according to the present invention, there is provided a device for dabbling in water, comprising: a body section having a support frame which possesses a configuration of a ring so that a user can freely pass through the ring; a first floating section having a plurality of first rods which are secured to the support frame to be spaced apart one from another by a predetermined angle in a circumferential direction and extend downward from the support frame, a plurality of second rods which are respectively coupled to the first rods, and a plurality of first floating parts which are respectively provided at the lower ends of the second rods to float the supporting frame and a user; and a second floating section containing a plurality of wires which are connected at their one end thereof to the support frame, and a pair of second floating parts adapted to be worn on the feet of the user and connected to the other ends of the wires.

BRIEF DESCRIPTION OF THE DRAWINGS

The above and other objects, features and other advantages of the present invention will be more clearly understood from the following detailed description when taken in conjunction with the accompanying drawings, in which.

BEST MODE FOR CARRYING OUT THE INVENTION

Figure 1:
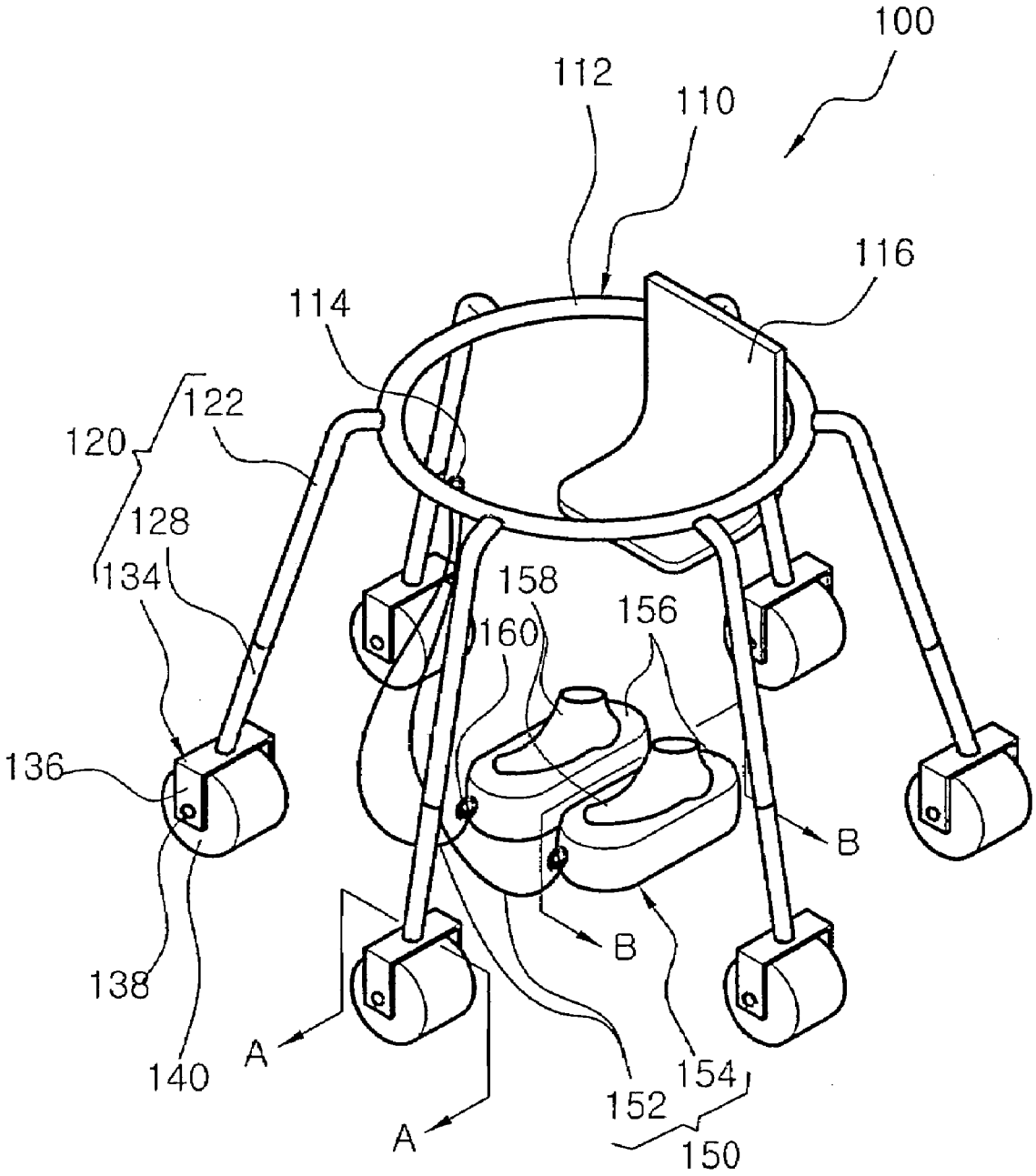
FIG. 1 is a perspective view illustrating a device for dabbling in water in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
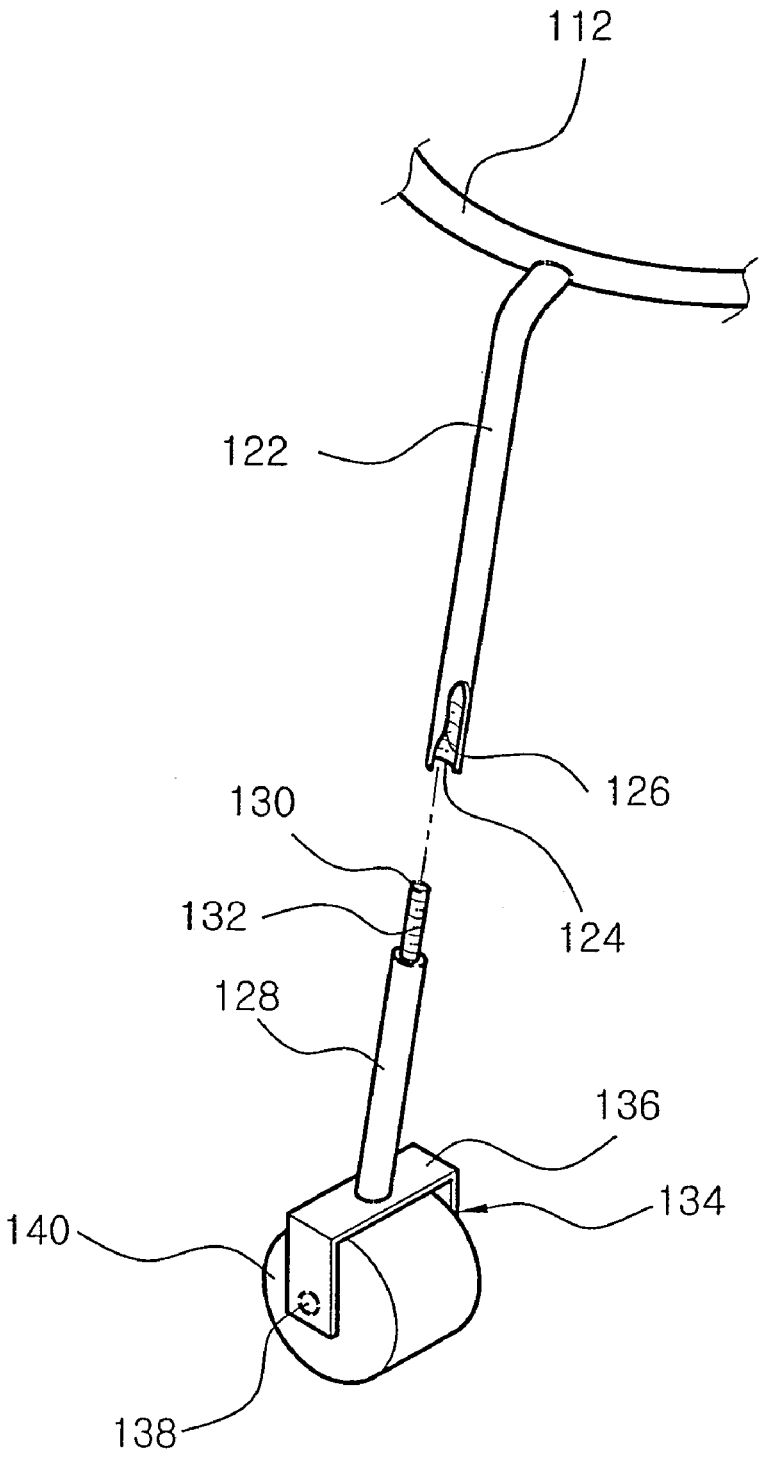
FIG. 2 an exploded perspective view illustrating a first floating section of the device shown in FIG. 1.
Figure 3:
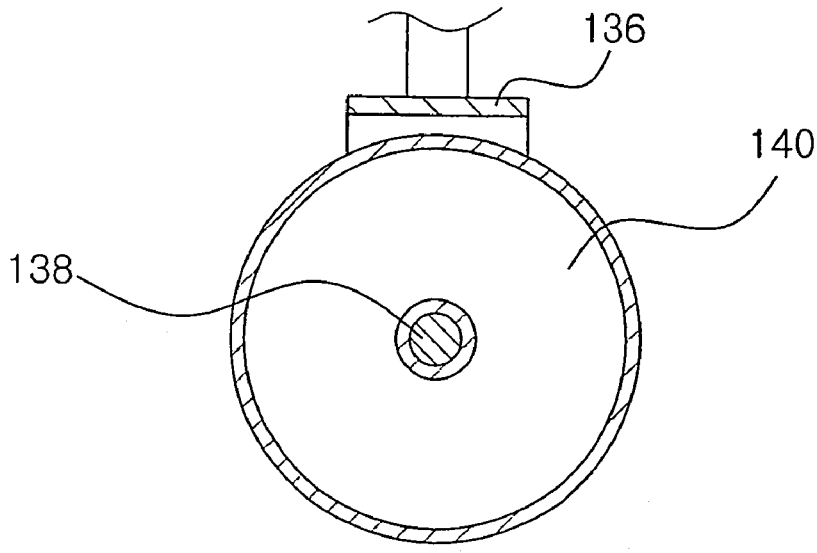
FIG. 3 is a sectional view taken along the line A—A of FIG. 1.
Figure 4:
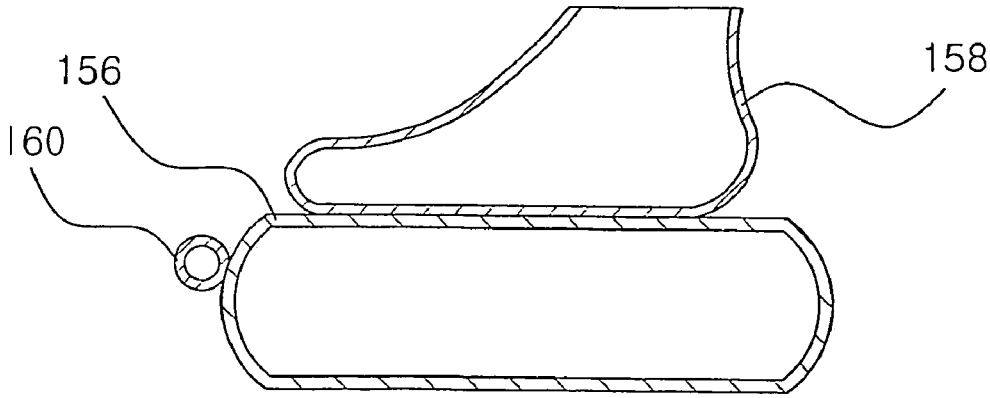
FIG. 4 is a sectional view taken along the line B—B of FIG. 1.
Figure 5:
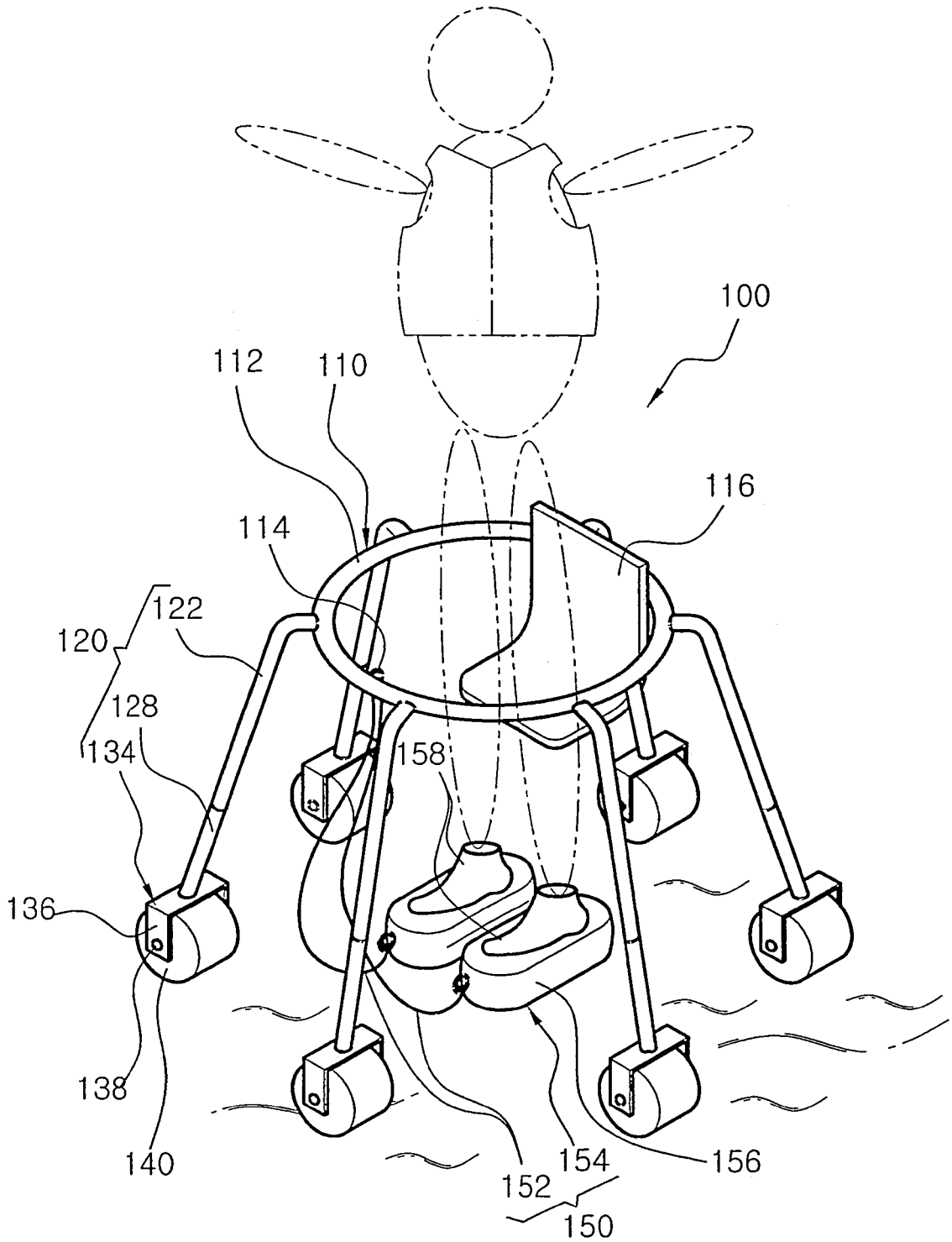
FIG. 5 is a view illustrating an in-use state of the device for dabbling in water of FIG. 1.

FIG. 1 is a perspective view illustrating a device for dabbling in water in accordance with an embodiment of the present invention; FIG. 2 is an exploded perspective view illustrating a first floating section of the device shown in FIG. 1; FIG. 3 is a sectional view taken along the line A—A of FIG. 1; FIG. 4 is a sectional view taken along the line B—B of FIG. 1; and FIG. 5 is a view illustrating an in-use state of the device for dabbling in water of FIG. 1.

Referring to FIGS. 1 through 4, a device 100 for dabbling in water in accordance with an embodiment of the present invention, comprises a body section 110, a first floating section 120 and a second floating section 150.

The body section 110 has a support frame 112 and a chair 116. The support frame 112 possesses the configuration of a ring. The inside surface of the support frame 112 defines a diameter which allows a user to freely pass through the support frame 112. A first ring 114 is fastened at a predetermined position to the inside surface of the support frame 112 to radially project toward a center of the support frame 112. The chair 116 is secured to the inside surface of the support frame 112 opposite to the first ring 114. Preferably, the chair 116 is detachably secured to the support frame 112. Due to the presence of the chair 116, the user can freely move his or her body and even easily walk on the surface of the water. The first and second floating sections 120 and 150 are installed on the body section 110 constructed as mentioned above.

The first floating section 120 has a plurality of first rods 122, a plurality of second rods 128, and a plurality of first floating parts 134. The first rod 122 has a cylindrical configuration. The first rods 122 are arranged on the support frame 112 to be spaced apart one from another by a predetermined angle in a circumferential direction. The first rods 122 extend downward from the support frame 112 in such a way as to be diverged outward from the support frame 112. The first rods 122 are defined at lower ends thereof with coupling holes 124 and formed in the coupling holes 124 with internal threads 126. The second rod 128 also has a cylindrical configuration similarly to the first rod 122. The second rods 128 are formed at upper ends thereof with coupling pins 130 which are to be respectively inserted into the coupling holes 124. The coupling pins 130 of the second rods 128 are formed on outer surfaces thereof with external threads 132 which are to be threadedly coupled into the internal threads 126. Each first floating part 134 comprises a bracket 136 which is rotatably affixed to a lower end of the second rod 128 and has substantially a 180°-rotated U-shaped configuration, and a floating wheel 140 which is rotatably mounted to both legs of the bracket 136 by a hinge 138. The floating wheel 140 has a hollow sectional shape to be floated on the surface of the water.

The second floating section 150 has a plurality of wires 152 and a pair of second floating parts 154. The wires 152 are connected at one ends thereof to the first ring 114 to extend downward from the support frame 112. Each second floating part 154 comprises a floating tube 156 to which at least one of the other ends of the wires 152 is connected, and an overshoe 158 which is integrally formed on an upper surface of the floating tube 156. A second ring 160 is fastened to one end of the floating tube 156 so that at least one of the other ends of the wires 152 is tied to the second ring 160. The floating tube 156 also has a hollow sectional shape to be floated on the surface of the water.

Hereafter, an in-use state of the device 100 for dabbling in water according to the present invention, constructed as mentioned above, will be described.

Referring to FIG. 5, in order to use the device 100 for dabbling in water according to the present invention, first, a length of the second rods 128 which are coupled to the first rods 122 is appropriately adjusted in conformity with the user's height. In a state wherein the length of the second rods 128 is adjusted in this way, the user inserts both legs through the support frame 112 from up to down and then secures the feet within the overshoes 158 of the second floating section 150. At this time, the user can put on a life jacket. In this state where the user is wearing the overshoes 158, if the user walks on the surface of the water in a river or the sea, the user can float on the surface of the water by the presence of the floating wheels 140 of the first floating section 120 and the floating tubes 156 of the second floating section 150. Therefore, the user can enjoy dabbling on the surface of the water while sitting on the chair 116 secured to the support frame 112.

INDUSTRIAL APPLICABILITY

As apparent from the above description, the device for dabbling in water according to the present invention provides advantages in that, due to the presence of first and second floating sections mounted to a support frame, it is possible to dabble on the surface of a river or the sea while in a standing posture and paddling on the surface of the water while in a sitting posture, whereby customers' interest can be aroused and a degree of recreation can be achieved.

The invention claimed is:

1. A device for dabbling in water, comprising:

a body section having a support frame which possesses a configuration of a ring so that a user can freely pass through the ring;

a first floating section having a plurality of first rods which are secured to the support frame to be spaced apart, one from another, by a predetermined angle in a circumferential direction and extend downward from the support frame, a plurality of second rods which are respectively coupled to the first rods, and a plurality of first floating parts which are respectively provided at the lower ends of the second rods to float the supporting frame and a user;

a second floating section having a plurality of wires which are connected at their one end thereof to the support frame, and a pair of second floating parts adapted to be worn on the feet of the user and connected to the other ends of the wires, wherein a first ring is fastened at a predetermined position to an inside surface of the support frame to radially project toward a center of the support frame so that one end of the wires are tied to the first ring; and a chair is secured to the inside surface of the support frame opposite the first ring.

2. The device as set forth in claim 1, wherein the first rods extend downward in such a way as to be diverged outward of the support frame and are defined at lower ends thereof with coupling holes; and the second rods are formed at upper ends thereof with coupling pins which are to be respectively inserted into the coupling holes.

3. The device as set forth in claim 2, wherein the first rods are formed in the coupling holes with internal threads; and the coupling pins of the second rods are formed on outer surfaces thereof with external threads.

4. The device as set forth in claim 1, wherein each first floating part comprises a bracket which is rotatably affixed to a lower end of the second rod and has substantially a 180°-rotated U-shaped configuration, and a floating wheel which is rotatably mounted to both legs of the bracket by a hinge and has a hollow sectional shape to be floated on the surface of the water.

5. A device for dabbling in water, comprising:

a body section having a support frame which possesses a configuration of a ring so that a user can freely pass through the ring;

a first floating section having a plurality of first rods which are secured to the support frame to be spaced apart, one from another, by a predetermined angle in a circumferential direction and extend downward from the support frame, a plurality of second rods which are respectively coupled to the first rods, and a plurality of first floating parts which are respectively provided at the lower ends of the second rods to float the supporting frame and a user;

a second floating section having a plurality of wires which are connected at their one end thereof to the support frame, and a pair of second floating parts adapted to be worn on the feet of the user and connected to the other ends of the wires, wherein each second floating part comprises a floating tube to which at least one of the other ends of the wires is connected and which has a hollow sectional shape, and an overshoe which is integrally formed on an upper surface of the floating tube; and wherein a second ring is fastened to one end of the floating tube so that at least one of the other ends of the wires is tied to the second ring.

* * * * *